United States Patent [19]

Dunleavy

[11] 4,200,127

[45] Apr. 29, 1980

[54] LEAF BAGGING EQUIPMENT AND METHOD

[76] Inventor: Daniel W. Dunleavy, 1315 N. Line St., Lansdale, Pa. 19446

[21] Appl. No.: 910,076

[22] Filed: May 26, 1978

Related U.S. Application Data

[63] Continuation-in-part of Ser. No. 766,714, Feb. 8, 1977, abandoned.

[51] Int. Cl.[2] ..... B65B 1/06

[52] U.S. Cl. ..... 141/10; 56/1; 56/329; 141/314; 141/391; 150/52 R

[58] Field of Search ..... 15/257.1; 141/114, 313–316, 141/390, 391, 392, 108, 109, 372, 1, 10; 150/1, 0.5, 52 R; 248/99, 100, 101; 53/390; 56/1, 329

[56] References Cited

U.S. PATENT DOCUMENTS

| | | | |
|---|---|---|---|
| 2,295,584 | 9/1942 | Larson | 141/391 X |
| 2,766,797 | 10/1956 | Cowen | 150/52 R |
| 3,692,072 | 9/1972 | Kohls | 141/391 |
| 4,058,956 | 11/1977 | Skonieczny | 150/0.5 X |

*Primary Examiner*—Frederick R. Schmidt
*Attorney, Agent, or Firm*—Raymond Underwood

[57] ABSTRACT

Leaf collecting equipment and a method for its use comprises a blanket having a central hole through it and an attachment means around the hole to which the blanket is secured, the attachment means having provisions for removably attaching a trash bag to it to receive leaves dropped through the blanket hole and the attachment means directly into the bag.

8 Claims, 8 Drawing Figures

LEAF BAGGING EQUIPMENT AND METHOD

Figure 1:
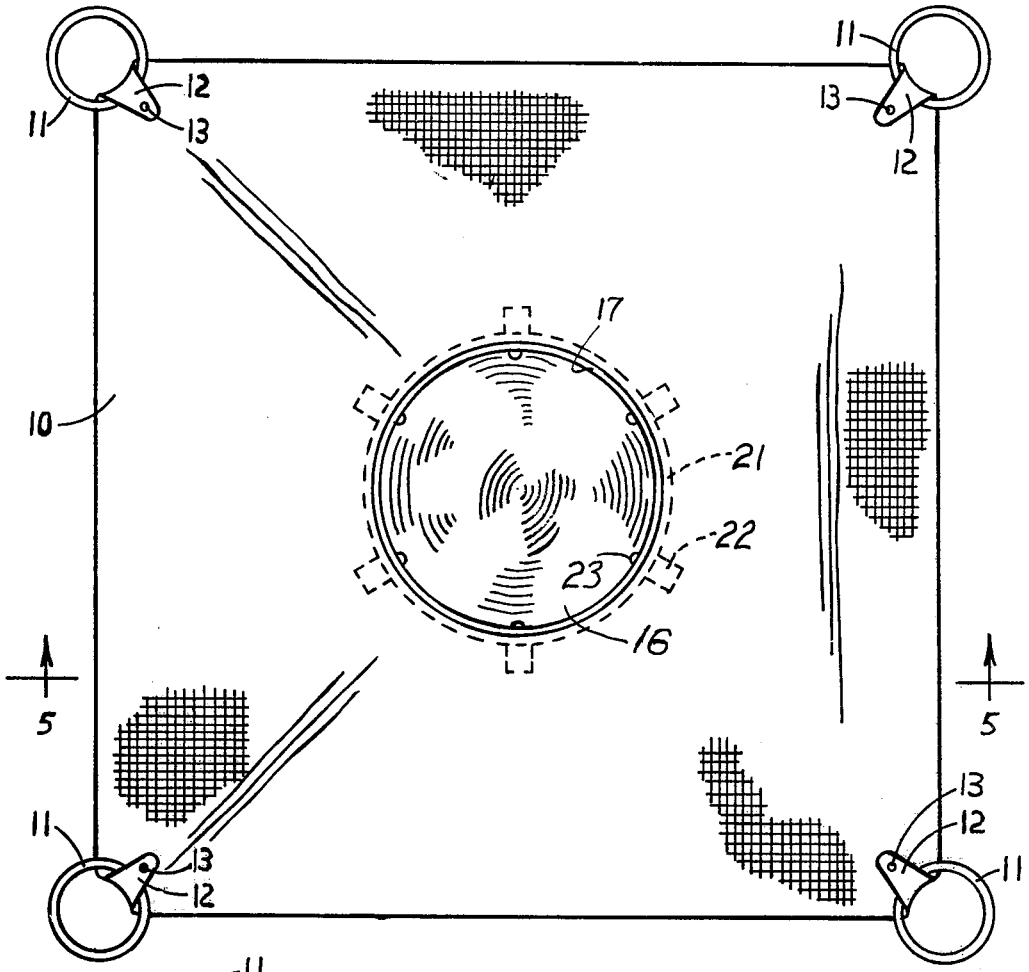

This is a continuation-in-part of my parent application Ser. No. 766,714, filed on Feb. 8, 1977 now abandoned.

This invention relates to leaf bagging equipment and particularly to an assembly on which the leaves are to be collected and from which the gathered leaves are to be deposited directly into a trash bag. The invention also includes the method of collecting leaves in a pile from a ground surface and putting the gathered leaves into a trash bag.

The inventon will be described with special reference to tree leaves but it is to be understood that the word "leaves" is used herein in a generic sense and is intended to include other debris which is to be gathered together and deposited in a trash bag for disposal. Such debris includes wood shavings, small cut pieces and the like, which are generally swept or raked together and then picked up and plced in a bag which is to be discarded.

The usual way for collecting leaves and putting them in a trash bag is time-consuming, awkward and cumbersome. After the leaves are swept or raked together in a pile, portions of it are picked up by hand, possibly with some assistance from a broom or rake, and then placed in a trash bag. As both hands are generally required to pick up the leaves and as the top of the bag must be opened it is apparent that a person finds it difficult to work alone. Even if two persons work together on the leaf collecting project, they find that the transfer of the pile of leaves to the inside of the trash bag is not easily accomplished.

The feature of the present invention is the provision of equipment which facilitates putting scattered leaves in a trash bag. The equipment includes a blanket or sheet on which the leaves are raked or swept and it provides a means for depositing the pile of leaves directed in a trash bag. The leaves are somewhat compacted on the blanket and dumped from the blanket into the bag without any manual handling of the leaves. There is no piece-meal handling of the collected leaves.

Figure 2:
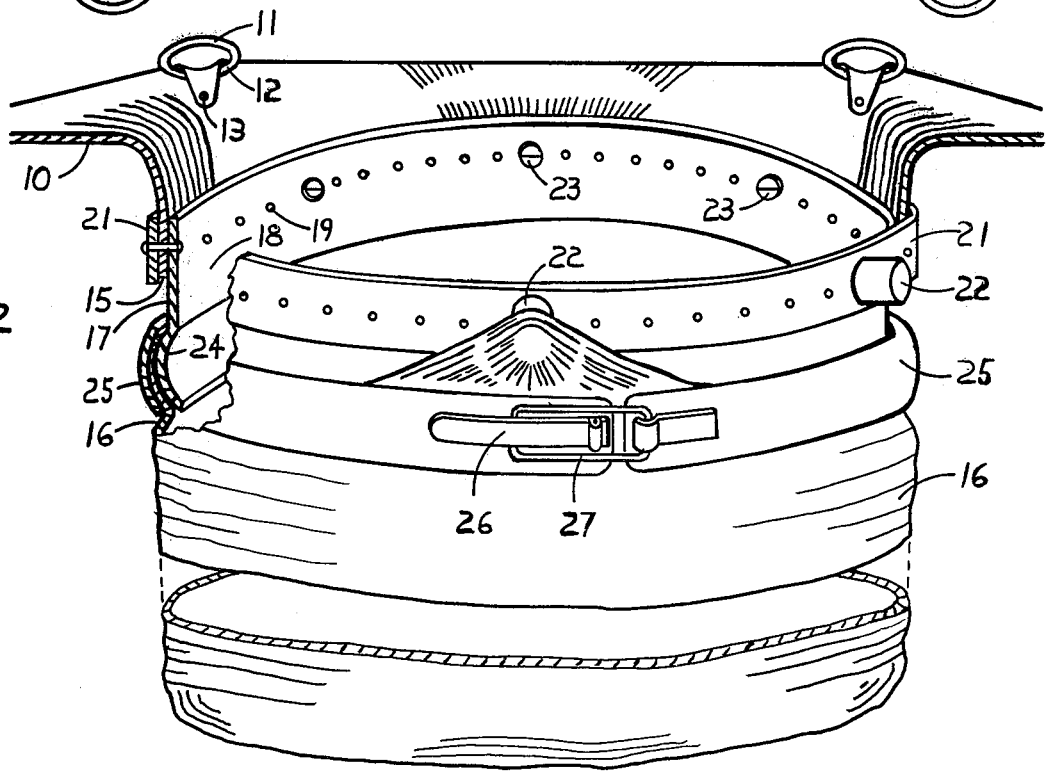
Figure 3:
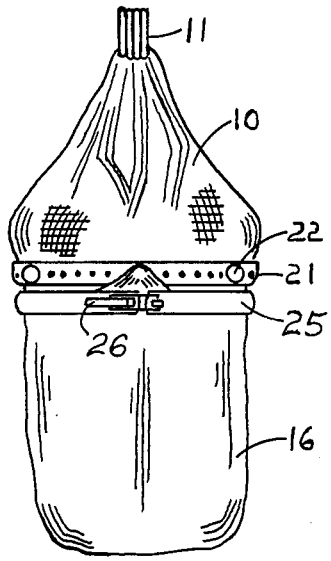
Figure 4:
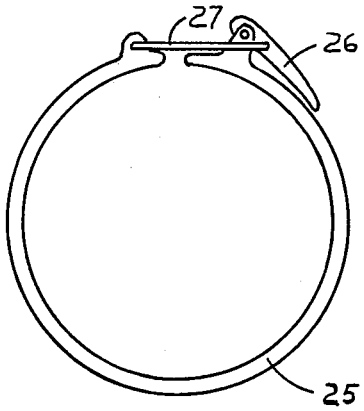
Figure 5:
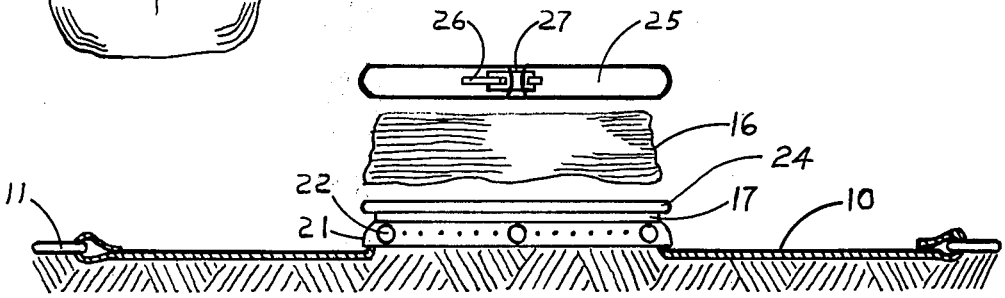
Figure 7:
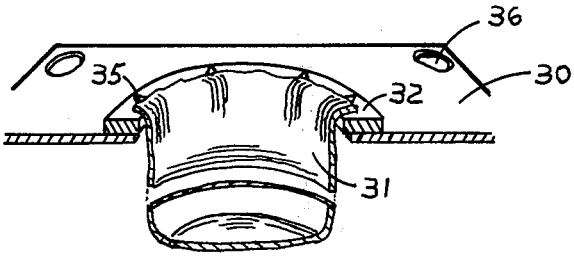
Figure 6:
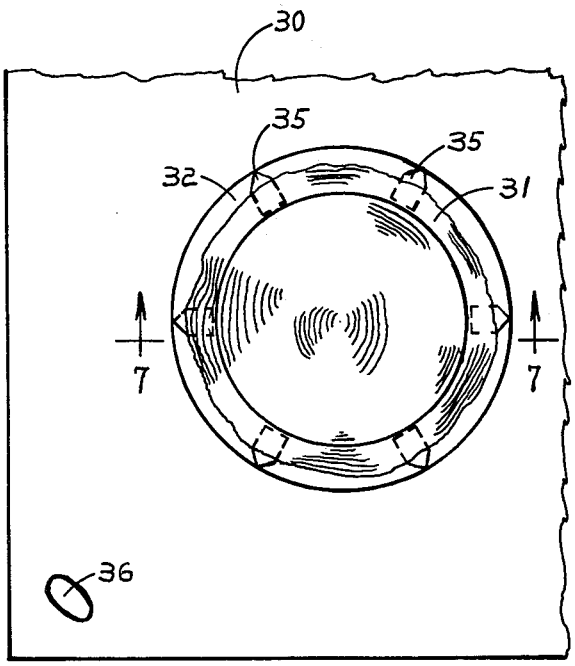
Figure 8:
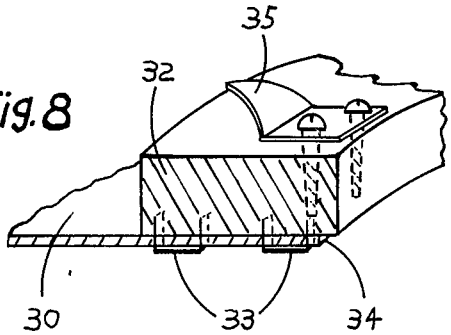

Representative embodiments of the invention are illustrated in the drawings, in which:

FIG. 1 is a plan view of a preferred construction of the equipment, ready for use, FIG. 2 is a side view of the equipment, in perspective, a front portion of the collecting blanket being removed, FIG. 3 is a side elevation showing the manner of dumping the collected leaves into a trash bag, FIG. 4 is a plan view of the clamping ring, FIG. 5 is a side elevation, upside-down from FIG. 2, showing the removable parts separated and ready for assembly to make the equipment of FIGS. 1 and 2, FIG. 6 is a plan view of a simplified construction of the equipment, FIG. 7 is a perspective view looking down on FIG. 6, parts being in section on the line 7—7 of FIG. 6, and FIG. 8 is a sectional view on an enlarged scale on the line 7—7 of FIG. 6 but only of the left hand portion thereof and with the trash bag removed.

Referring first to FIGS. 1 to 5, the blanket 10 is a cloth or plastic sheet on which the leaves are raked or swept. It is spread out on the ground at an appropriate place close to the leaves which are to be collected and the leaves are gathered on it in one or more piles. It may be made of any flexible material which is strong enough to resist the raking and pulling to which it will be subjected. It is shown as square but it may be oblong or curved in outline.

At the four corners of the sheet are attached rings 11 and they serve the double purpose of holding the sheet in a spread-out position and providing handles to spread the sheet out on the ground as shown in FIG. 1 and to pick it up as is shown in FIG. 3. The rings are attached to the blanket 10 by folding the corners of the blanket through them to form the tabs 12 which are fastened by rivets 13 or other means to the blanket. Or, the rings 11 may simply be stitched to the blanket. In fact the rings can be eliminated as they are not vital to the use of the equipment, because without the rings the corners of the blanket can be grasped firmly and raised high enough to shake the leaves or debris to and through the center hole as will be explained.

The blanket 10 has a large hole 15 through it at or near its center and an important feature of the inventon is that the leaves which have been collected on the blanket are to be discharged through this hole and directly into the removably attached trash bag 16. The attachment means between the blanket 10 and the trash bag 16, in the structure of FIGS. 1 to 5, includes a collar or sleeve 17 which is of generally cylindrical shape. At this point it may be mentioned that the blanket is permanently attached to this central fastening means and that the trash bag is removably fastened to it.

The marginal area of the blanket around the hole 15 is attached to one end portion or zone 18 of the sleeve 17 by any suitable fastening means such as the staples or rivets 19. To more firmly hold the blanket on the cylindrical end portion 18 an outer hoop or band 21 may be, but not necessarily, provided. The rivets 19 then tightly clamp the blanket around its hole 15, between the outer band 21 and the cylindrical end zone 18. If the band 21 has a tight enough frictional fit the rivets 19 may be eliminated.

The collar 17 is preferably made of metal such as steel but it can be made of a strong, relatively inflexible plastic. The band 21 may be made of metal or plastic and the collar and the band need not be made of the same material.

At spaced intervals around the outside of the band 21 are radially projecting hubs or bosses 22 for a purpose which will be explained. From two to eight of them will be sufficient for this purpose but they may be omitted altogether. They are held in place by the screws 23 which pass through the central collar 17. Of course, if the band 21 is omitted the hubs will be held against the blanket itself and serve to further hold it in place.

The trash bag is to be temporarily attached to the other end portion 24 of the collar 17 and this is accomplished by the expansible-contractible clamping ring 25. It is of the conventional split ring type so that its ends may be drawn firmly toward each other to grip the end of the trash bag to the end portion 24 or the ends may spring apart to release the trash bag. It is generally made of metal but may be made of a strong plastic.

The details of a usable clamping ring are shown in FIG. 4. A lever 26 is pivoted to one end of the ring 25 and a link 27 is pivoted to the other end of the ring and also to the lever. This is the usual "over the center" arrangement as it is self locking in the position shown in FIG. 4. When the handle or lever 26 is pulled far enough away from the split ring 25 the ring opens wide and the trash bag 16 is instantly released.

FIG. 5 shows how the structure is assembled for use. The blanket 10 is placed on the ground with the collar 17 sticking upwardly. The open end of the trash bag is drawn downwardly over the end portion 24 of the collar and, if the bosses 22 are present, the bag is pulled over several of them to stretch the bag so it will be tightly held on the collar 17. This is to reduce the chances that the bag will slip off while the clamping ring 25 is being applied.

When the trash bag is upon the collar the clamping ring is moved over the bag and to a position around the end portion 24. If the bosses 22 are present they serve as positioning stops to more quickly and accurately locate the ring 25 where it should be clamped. Then the lever 26 is moved to its self locking position and the equipment is ready for use.

To use it, the blanket 10 is spread out on the ground with the trash bag on it under side as shown in FIG. 2. As there is nothing in the bag and as it is thin the entire blanket lies quite flat and leaves can be raked or swept on its entire upper side. When it is felt that a sufficient load of leaves is on the blanket the rings are picked up and brought together as is shown in FIG. 3. If there are no rings, as mentioned above, the corners or edges of the blanket are firmly grasped in the hands and brought together. The leaves are then easily shaken through the hole 15 directly into the trash bag. If the bag is not full this action is repeated as the presence of some leaves in the bag will not interfere too much with spreading out the blanket.

When the bag is full the position of FIG. 3 is maintained while the clamping ring is released and the ring will open and drop down over the bag to the ground. The top of the bag is held in one hand while the blanket and attached collar are discarded with the other hand. Finally, the open end of the trash bag is closed in and a draw string or tab is applied to hold the bag closed.

The end portion 24 of the collar 17 may be of simple cylindrical shape similar to the end portion 18 but a refinement in the structure is to slightly bow the portion 24 in cross section as is shown in FIG. 2. Then the clamping ring 25 should be bowed in like manner as is shown in FIG. 2 so that the surfaces complement each other. This interfit between the end portion 24 and the clamping ring 25 serve to more securely hold the clamping ring in place and retain the trash bag.

To produce an inexpensive structure, the collar 17, the outer band 21 and the clamping ring 25 may be the parts which are at the open end of the conventional fiberbroad container. The blanket 10 occupies the space between the collar 17 and band 21 which could be occupied by the open end of a fiberboard container. The clamping band 25 may be the same one which holds a lid on the conventional fiberboard container.

FIGS. 6, 7 and 8 show a more simplified structure. Instead of the cylindrical collar of the preferred structure, the central attachment means between the blanket 30 and the trash bag 31 is a flat annulus 32. This annulus may be made out of wood or a plastic in which nails may be driven. FIG. 8 shows that the blanket 30 is attached around its central hole 34 to the annulus 32 by staples 33. A strong glue may be used to permanently or semipermanently fasten them together.

Secured to the upper side of the annulus is a ring of clips 35 or prongs over which the trash bag is drawn to releasibly hold the bag in place. To use this equipment the bag is drawn up through the holes in the annulus and the blanket and hooked on the prongs 35 to hold the bag in place. This assembly is used as described above.

As the prongs 35 may tear an ordinary thin plastic trash bag it may be found to be best to use a burlap or a canvas bag with this equipment. This may be the same material which is used to make the blanket or sheet 30 or 10. Instead of the more expensive rings 11 to handle the blanket, the blanket 30 has holes 36 in it at its corners and the blanket is stitched around these holes to strengthen it when the blanket is grasped. These holes 36, like the rings, may be omitted and in this case the corners or edges of the blanket are manually grasped and brought up to form a funnel shape out of the blanket or sheet.

In both structures the central attachment means serves to strengthen the blanket around the hole, to hold the hole open so all the leaves will be dumped through it, and to contain a provision for holding the trash bag so it will receive the leaves being shaken off the blanket. This makes it possible for the blanket to be both a leaf collecting sheet and subsequently a funnel to direct the collected leaves into the removable trash bag.

Many variations and combinations or substitutes of details are possible. Instead of using the clamping ring 25, the end portion 24 may be provided with hooks or prongs, like the prongs 35, on which the trash bag is hung. The hole in the blank need not be round as it can be oval, square or oblong and in this case the attachment means should have the same formation. For instance, the annulus 32 need not be circular as it may be rectangular and frame-like in its formation.

I claim:

1. Leaf bagging equipment comprising a blanket which is of sheet form and is free and of unshaped contour around its peripheral edge, the peripheral edge being unsupported and including spaced handling means, and thereby is adapted to be spread out to lie flat on the ground or to be picked up at its periphery by said handling means and be brought together to form a funnel shape, the leaves being collectable on the blanket directly as a pick up sheet when it is spread out, said blanket having a centrally located hole through it, to which and through which the leaves are delivered when the periphery of the blanket is picked up and gathered together to form a funnel shape, an attachment means around the hole to hold it open and to which the blanket is secured, and said attachment means also including means for temporarily attaching a removable trash bag to it to directly receive leaves dropped through the blanket hole and attachment means, whereby when said blanket is picked up at said handling means and they are brought together to form said funnel shape said attachment means is maintained in an essentially horizontal position so that the leaves flow down unobstructedly through said hole.

2. Leaf bagging equipment comprising a blanket which is of sheet form and is free and of unshaped contour around its peripheral edge, the peripheral edge being unsupported and free to be spread out to lie flat on the ground or to be picked up at spaced points around it periphery and be brought together to form a funnel shape, the leaves being collectable on the blanket directly as a pickup sheet when it is spread out, said blanket having a centrally located hole through it, to which and through which the leaves are delivered when the periphery of the blanket is picked up and gathered together to form a funnel shape, an attachment means around the hole to hold it open and to which the blanket is secured, and said attachment means also including means for temporarily attaching a removable trash bag to it to directly receive leaves dropped through the blanket hole and attachment means, whereby when said blanket is picked up at said spaced points around its periphery and they are brought together to form said funnel shape said attachment means is maintained in an essentially horizontal position so that the leaves flow down unobstructedly through said hole.

3. The equipment of claim 2 in which said attachment means is of generally circular shape, the blanket being secured to one portion thereof and another portion having said means for temporarily attaching the trash bag.

4. The equipment of claim 2 in which said attachment means is of generally cylindrical shape and said means for temporarily attaching a removable trash bag is an expansible-contractible ring.

5. The equipment of claim 2 in which said attachment means is a generally flat frame.

6. The equipment of claim 2 in which said attachment means is an annulus.

7. The equipment of claim 2 in which said attachment means is of generally cylindrical shape and has radially projecting bosses around its exterior.

8. The method for bagging leaves and like debris from the ground which comprises removably attaching the opened end of a collapsible trash bag to a blanket of sheet form around the edge of a centrally located hole through the blanket, spreading the blanket out flatwise on the ground with the collapsed trash bag on the under side, collecting leaves on the top side of the spread out blanket, picking up the peripheral edge of the blanket at spaced points to thereby form it into a funnel shape and also move the leaves to and through said central opening and into the trash bag and removing the trash bag with its enclosed leaves from the blanket, whereby in the action of picking up the blanket at said spaced points around its periphery and bringing them together to form said funnel shape said attachment is maintained in an essentially horizontal position so that the leaves flow down unobstructedly through said hole.

* * * * *